US009728126B2

(12) United States Patent
Lee et al.

(10) Patent No.: US 9,728,126 B2
(45) Date of Patent: Aug. 8, 2017

(54) ORGANIC LIGHT EMITTING DISPLAY APPARATUS HAVING IMPROVED UNIFORMITY IN DISPLAY BRIGHTNESS, AND METHOD OF DRIVING THE SAME

(71) Applicant: SAMSUNG DISPLAY CO., LTD., Yongin, Gyeonggi-Do (KR)

(72) Inventors: Jae-Hoon Lee, Yongin (KR); Baek-Woon Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 278 days.

(21) Appl. No.: 14/466,731

(22) Filed: Aug. 22, 2014

(65) Prior Publication Data

US 2015/0262529 A1 Sep. 17, 2015

(30) Foreign Application Priority Data

Mar. 14, 2014 (KR) ..... 10-2014-0030469

(51) Int. Cl.
*G09G 3/32* (2016.01)
*G09G 3/3233* (2016.01)

(52) U.S. Cl.
CPC ... *G09G 3/3233* (2013.01); *G09G 2300/0426* (2013.01); *G09G 2320/0233* (2013.01)

(58) Field of Classification Search
CPC ..... G09G 3/3266; G09G 2320/0233; G09G 2300/0426
USPC ..... 345/79
See application file for complete search history.

(56) References Cited

U.S. PATENT DOCUMENTS

| | | | | |
|---|---|---|---|---|
| 7,432,886 | B2 | 10/2008 | Song et al. | |
| 7,453,531 | B2 | 11/2008 | Lee | |
| 2005/0280353 | A1 | 12/2005 | Sun | |
| 2011/0018787 | A1* | 1/2011 | Nakamura | G09G 3/3233 345/76 |
| 2011/0128268 | A1* | 6/2011 | Kim | G09G 3/3225 345/211 |
| 2012/0287092 | A1* | 11/2012 | Tatara | G09G 3/3233 345/204 |
| 2013/0222350 | A1 | 8/2013 | Tanaka et al. | |
| 2014/0160179 | A1* | 6/2014 | Ishii | G09G 3/3233 345/690 |

FOREIGN PATENT DOCUMENTS

| | | |
|---|---|---|
| KR | 2002-0057028 | 7/2002 |
| KR | 2003-0081610 | 10/2003 |
| KR | 10-2008-0062932 | 7/2008 |

* cited by examiner

*Primary Examiner* — Jonathan Blancha
(74) *Attorney, Agent, or Firm* — Lewis Roca Rothgerber Christie LLP

(57) ABSTRACT

An organic light emitting display apparatus includes: a plurality of pixels, each of the pixels including a light emitting device and a driving transistor configured to supply a driving current to the light emitting device based on a scan signal and a data signal; and a plurality of power lines configured to transfer a power voltage supplied from a global power line to the driving transistor of each of the pixels, wherein a level of a gate voltage of the driving transistor when the light emitting device emits light is determined by a distance between a corresponding one of the pixels and the global power line.

19 Claims, 6 Drawing Sheets

ORGANIC LIGHT EMITTING DISPLAY APPARATUS HAVING IMPROVED UNIFORMITY IN DISPLAY BRIGHTNESS, AND METHOD OF DRIVING THE SAME

CROSS-REFERENCE TO RELATED APPLICATION

This application claims priority to and the benefit of Korean Patent Application No. 10-2014-0030469, filed on Mar. 14, 2014, in the Korean Intellectual Property Office, the disclosure of which is incorporated herein in its entirety by reference.

BACKGROUND

1. Field

One or more embodiments of the present invention relate to an organic light emitting display apparatus and a method of driving the organic light emitting display apparatus.

2. Description of the Related Art

An organic light emitting display apparatus displays images by using an organic light emitting diode (OLED) that emits light by using recombination of electrons and holes, and has characteristics such as fast response speed and low power consumption.

An organic light emitting display apparatus (for example, an active matrix type organic light emitting display apparatus) includes a plurality of scan lines, a plurality of data lines, a plurality of power lines, and a plurality of pixels coupled to the above lines to be arranged as a matrix.

The plurality of power lines supply a power voltage supplied from outside of a display panel to the plurality of pixels, and uneven brightness according to locations of the pixels may be caused due to a voltage dropping in the power lines.

SUMMARY

One or more embodiments of the present invention include an organic light emitting display apparatus and a method of driving the organic light emitting display apparatus, and in particular, an organic light emitting display apparatus having an increased (e.g., improved) uniformity in a display brightness and a method of driving the organic light emitting display apparatus.

Additional aspects will be set forth in part in the description which follows and, in part, will be apparent from the description, or may be learned by practice of the presented embodiments.

According to one or more embodiments of the present invention, an organic light emitting display apparatus including: a plurality of pixels, each of the pixels including a light emitting device and a driving transistor configured to supply a driving current to the light emitting device based on a scan signal and a data signal; and a plurality of power lines configured to transfer a power voltage supplied from a global power line to the driving transistor of each of the pixels, wherein a level of a gate voltage of the driving transistor when the light emitting device emits light is determined by a distance between a corresponding one of the pixels and the global power line.

An absolute value of a gate-source voltage level at the driving transistor when the light emitting device emits light may increase as the distance between the corresponding one of the pixels and the global power line increases.

The plurality of pixels may be at a display area, the global power line may be at an outside of the display area, and an absolute value of a gate-source voltage level at the driving transistor may increase as a distance between the corresponding one of the pixels and the outside of the display area increases.

The organic light emitting display apparatus may further include a data driver configured to acquire a data control signal from a controller and to generate the data signal based on the data control signal, wherein the data signal includes an image signal and an emphasis signal, the plurality of pixels are at a display area, and the data control signal includes information of the emphasis signal determined according to a location of the corresponding one of the pixels at the display area.

The information of the emphasis signal may include a voltage level and an application time of the emphasis signal, and at least one of the voltage level and the application time is determined based on a distance between a power supplier and the pixel.

The global power line may be at the outside of the display area to be coupled to an end or opposite ends of each of the power lines, and at least one of the voltage level and an application time of the emphasis signal may be increased as a distance between the corresponding one of the pixels and the outside of the display area increases.

The emphasis signal may be determined by following equation, $$Vg(1H) = Vhe\left(1 - e^{-\frac{1H}{\tau}}\right)\cdot u(1H) - (Vhe - Vh)\left(1 - e^{-\frac{(1-\beta)\cdot 1H}{\tau}}\right)\cdot u((1-\beta)\cdot 1H) \text{ where } 0 \le \beta < 1$$

wherein Vg denotes a gate voltage of the driving transistor, Vhe denotes a voltage level of the emphasis signal, 1H denotes a unit period of the data signal, $\tau$ denotes a time constant, Vh is an on-level of the image signal, and $\beta\cdot 1H$ is an application time of the emphasis signal.

An on-level of the image signal may be a logic high level or a logic low level, and the voltage of the emphasis signal may be greater than the logic high level of the image signal or less than the logic low level of the image signal.

The emphasis signal may include a first emphasis signal and a second emphasis signal, and a voltage of the first emphasis signal may be greater than the logic high level of the image signal and a voltage of the second emphasis signal may be less than the logic low level of the image signal.

The first emphasis signal may be supplied before supplying the logic high level and the second emphasis signal may be supplied before supplying the logic low level.

The plurality of pixels may be arranged in columns and rows at a display area, the plurality of power lines may be at each of the columns or at each of the rows of the pixels, the global power line may be at an outside of a display panel, the plurality of power lines may include a directly coupled power line and an indirectly coupled power line, an end or opposite ends of the directly coupled power line may be coupled to the global power line to receive the power voltage, and the indirectly coupled power line may be electrically coupled to the directly coupled power line via an auxiliary line to receive the power voltage via the directly coupled power line.

A size of the driving transistor may increase as a distance between the corresponding one of the pixels and the global power line increases.

The size of the driving transistor may be expressed by at least one of a channel width and a channel length of the driving transistor.

Sizes of pixels from among the plurality of pixels coupled to a same power line may increase as a distance between the pixels coupled to the same power line and the outside of the display area increases.

A size of a pixel from among the plurality of pixels coupled to the indirectly coupled power line may be greater than a size of a pixel from among the plurality of pixels coupled to the directly coupled power line.

The power line may be at each of the columns of pixels, and a size of a pixel from among the pixels included in a same row coupled to the indirectly coupled power line may be greater than a size of a pixel from among the pixels included in the same row coupled to the directly coupled power line.

The power line is at each of the rows of pixels, and a size of a pixel from among the pixels included in a same column coupled to the indirectly coupled power line may be greater than a size of a pixel from among the pixels included in the same column coupled to the directly coupled power line.

A size of the corresponding one of the pixels coupled to the indirectly coupled power line may increase when a distance between the indirectly coupled power line and the directly coupled power line that are coupled to each other via the auxiliary line increases.

According to one or more embodiments of the present invention, there is provided an organic light emitting display apparatus including: a plurality of pixels, each of the pixels including a light emitting device and a driving transistor configured to supply a driving current to the light emitting device based on a scan signal and a data signal; and a plurality of power lines configured to transfer a power voltage supplied from a global power line to the driving transistor of each of the pixels, wherein a unit period 1 h of the data signal includes an emphasis period during which an emphasis signal is input and an image period during which an image signal is input, and a magnitude of the emphasis signal or a length of the emphasis period may be determined according to a distance between each of the pixels and the global power line.

According to one or more embodiments of the present invention, there is provided a method of driving a display apparatus including: a plurality of pixels; a plurality of data lines coupled to the plurality of pixels, and power lines configured to apply power voltages supplied from a global power line to the plurality of pixels, the method including: outputting a data control signal including information about an image signal and information about an emphasis signal by a controller according to locations of each of the plurality of pixels, wherein the data control signal is input to each of the plurality of pixels; receiving the data control signal by a data driver from the controller; and outputting a data signal including the image signal and the emphasis signal by the data driver based on the data control signal, wherein the data signal includes a unit period that corresponds to a sub-frame of a digital driving method, and the unit period includes an emphasis period during which the emphasis signal is input and an image period during which the image signal is input, and the outputting of the data control signal includes outputting information of the emphasis signal according to a length of the emphasis signal, which is determined according to a distance between each of the pixels and the global power line.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
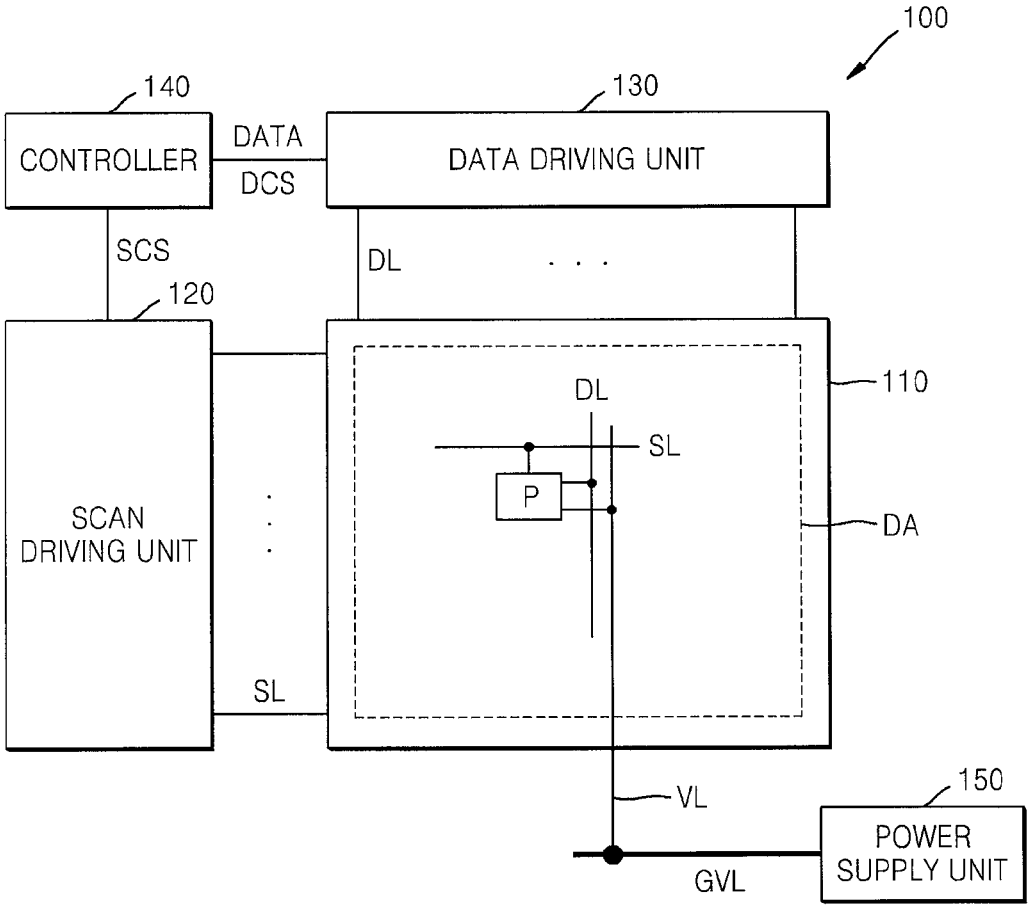
FIG. 1 is a schematic block diagram of an organic light emitting display apparatus according to an embodiment of the present invention.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Hereinafter, the present invention will be described in detail by explaining preferred embodiments of the invention with reference to the attached drawings. Like reference numerals in the drawings denote like elements.

It will be understood that although the terms "first", "second", etc. may be used herein to describe various components, these components should not be limited by these terms. These components are only used to distinguish one component from another. As used herein, the singular forms "a," "an" and "the" are intended to include the plural forms as well, unless the context clearly indicates otherwise. It will be further understood that the terms "comprises" and/or "comprising" used herein specify the presence of stated features or components, but do not preclude the presence or addition of one or more other features or components. When a first element is described as being "coupled" or "connected" to a second element, the first element may be directly "coupled" or "connected" to the second element, or one or more other intervening elements may be located between the first element and the second element.

In the following embodiments, a row direction and a column direction may be applied vice versa.

FIG. 1 is a schematic block diagram of an organic light emitting display apparatus 100 according to an embodiment of the present invention.

Referring to FIG. 1, the organic light emitting display apparatus 100 includes a display panel 110, a scan driving unit (or a scan driver) 120, a data driving unit (or a data driver) 130, and a controller 140.

The display panel 110 according to the present embodiment may operate in a digital driving type, and includes pixels P, scan lines SL, data lines DL, and power lines VL.

The pixels P are arranged as a matrix in columns and rows. Each of the data lines DL is coupled to the pixels P in the same column to transfer data signals to the pixels P in the same column. Each of the scan lines SL is coupled to pixels P in the same row to transfer scan signals to the pixels P in the same row. Each of the power lines VL is at each of the columns including pixels P to supply power voltages to the pixels P in the same column. In FIG. 1, each of the power lines VL is at each of the columns of the pixels P; however, each of the power lines VL may be at each of the rows of the pixels, and in this case, each of the power lines VL is coupled to the pixels P in the same row to supply the power voltages to the pixels P in the same row. The pixels P are at a display area (e.g., a display unit). The power lines VL may receive power voltages from a global power line GVL at an outside of the display area DA. The global power line GVL receives a power voltage from a power supply unit (or a power supplier) 150, and transfers the power voltage to the power lines VL. The global power line GVL is not limited to a specific type, that is, it may use a film wire, a wire line, etc.

A data signal may be a digital signal having an on-level and an off-level, and a pixel P receiving the digital signal may emit light or may not emit light according to a logic level of the digital signal. In the present specification, it is assumed that a pixel P receiving the digital data signal emits light when the digital data signal has an on-level, and the pixel P does not emit light when the digital data signal has an off-level. According to a circuit configuration of the pixel P, the on-level may be a high level. According to another embodiment of the present invention, the on-level may be a low level.

Hereinafter, embodiments of the present invention will be described under an assumption where the organic light emitting display apparatus 100 operates in a digital driving manner. According to the embodiment of the present invention, a state of the light emitting device in each pixel P may be classified as an emission state or a non-emission state. However, one or more embodiments of the present invention may be applied to an organic light emitting display apparatus operating in an analog driving manner. In a case where the organic light emitting display apparatus 100 operates in the digital driving manner, one frame includes a plurality of sub-fields, and a length (for example, a display duration time) of each of the sub-fields may be determined according to a weight applied to each sub-field. Each of the sub-fields may include an image signal of an on-level or an off-level.

Each of the pixels P may include a pixel circuit and a light emitting device coupled to the pixel circuit. The pixels P will be described later with reference to FIG. 2.

Referring to FIG. 1, the controller 140 receives image data from outside and controls the scan driving unit 120 and the data driving unit 130. The controller 140 generates a plurality of control signals SCS and DCS and digital data DATA. The controller 140 provides the scan driving unit 120 with a first control signal SCS, and provides the data driving unit 130 with a second control signal DCS and the digital data DATA. Hereinafter, the first control signal SCS may be referred to as a scan driving signal, and the second control signal DCS may be referred to as a data control signal.

The scan driving unit 120 drives the scan lines SL according to a set order (e.g., a predetermined order) in response to the first control signal SCS. For example, the scan driving unit 120 may generate scan signals S and provide the pixels P with the scan signals S via the scan lines SL.

The data driving unit 130 drives the data lines DL in response to the second control signal DCS and the digital data DATA. The data driving unit 130 may generate data signals corresponding respectively to the data lines DL, and provide the pixels P with the data signals via the data lines DL.

Figure 2:
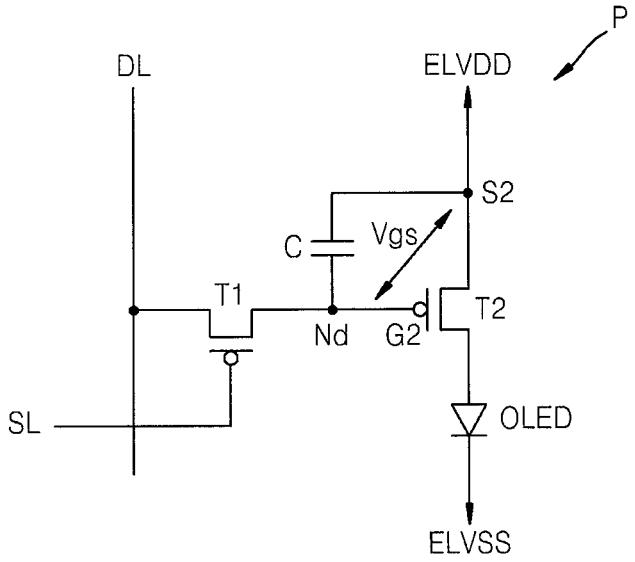
FIG. 2 is a circuit diagram showing a circuit configuration of a pixel of the organic light emitting display apparatus according to an embodiment of the present invention.

FIG. 2 is a circuit diagram showing a circuit configuration of a pixel P in the organic light emitting display apparatus 100 according to the present embodiment.

Referring to FIG. 2, each of the pixels P is coupled to the scan lines SL in the same row and the data lines DL in the same column. The pixel P includes a first transistor T1, a second transistor T2, a capacitor C, and an organic light emitting diode (OLED).

The first transistor T1 includes a first connection terminal coupled to the data line DL, a control terminal coupled to the scan line SL, and a second connection terminal coupled to a node Nd. The second transistor T2 includes a first connection terminal coupled to a first power voltage ELVDD, a control terminal coupled to a node Nd, and a second connection terminal coupled to a first electrode of the OLED. The OLED includes the first electrode coupled to the second connection terminal of the second transistor T2, and a second electrode to which a second power voltage ELVSS is applied. The first electrode and the second electrode of the OLED may be respectively an anode and a cathode, or vice versa.

The pixel P receives a scan signal S via the scan line SL and a digital data signal D via the data line DL. The first transistor T1 stores the digital data signal D in the capacitor C in response to the scan signal S. The second transistor T2 is turned on or turned off according to a logic level of the digital data signal D stored in the capacitor C. When the second transistor T2 is turned on, an electric current flows through the second transistor T2 and the first power voltage ELVDD is transmitted to the first electrode of the OLED. For example, when the digital data signal D has an on-level, the first power voltage ELVDD is applied to the first electrode of the OLED, and a driving current is supplied to the OLED so that the OLED emits light. When the digital data signal D has an off-level, the second transistor T2 is turned off and the first power voltage ELVDD is not applied to the first electrode of the OLED, and thus, the OLED does not emit light.

Hereinafter, the first transistor T1, the second transistor T2, and the capacitor C may be referred to as a pixel circuit, the first transistor T1 may be referred to as a switching transistor, and the second transistor T2 may be referred to as a driving transistor. In addition, the configuration of the pixel P shown in FIG. 2 is an example, and the pixel P may have different pixel configuration. For example, the pixel P may further include another transistor and another capacitor.

A brightness of the OLED is determined by an electric current flowing in the OLED. In a case of the pixel circuit shown in FIG. 2, the electric current flowing in the OLED may be equal to that of the second transistor T2. The electric current flowing in the second transistor T2 shown in FIG. 2 may be represented by equation 1.

$$I_{T2}=k\times\{(Vsg+Vth)(ELVDD-V_{OLED})-0.5\times(ELVDD-V_{OLED})^2\} \quad (1)$$

Here, $I_{T2}$ denotes an electric current flowing in the second transistor T2, k is a constant according to a characteristic of the second transistor, Vsg is a source-gate voltage of the second transistor T2, Vth is a threshold voltage of the second transistor T2, $V_{OLED}$ is a voltage at the second connection terminal of the second transistor T2, that is, a voltage at the first electrode of the OLED in the pixel circuit shown in FIG. 2.

When the first power voltage and the second power voltage applied to two pixels P are equal to each other and the pixel circuits and the OLEDs are the same as each other, when the same data signals are applied to the two pixels P, the same gate voltages are applied to the driving transistors T2 and the OLEDs in the two pixels P emit light of the same brightness. However, when the first power voltage and the second power voltage applied to the two pixels P are different from each other, even when the same data signals are applied so as to apply the same gate voltages to the driving transistors T2, the OLEDs of the two pixels P may not emit light of the same brightness.

Figure 3:
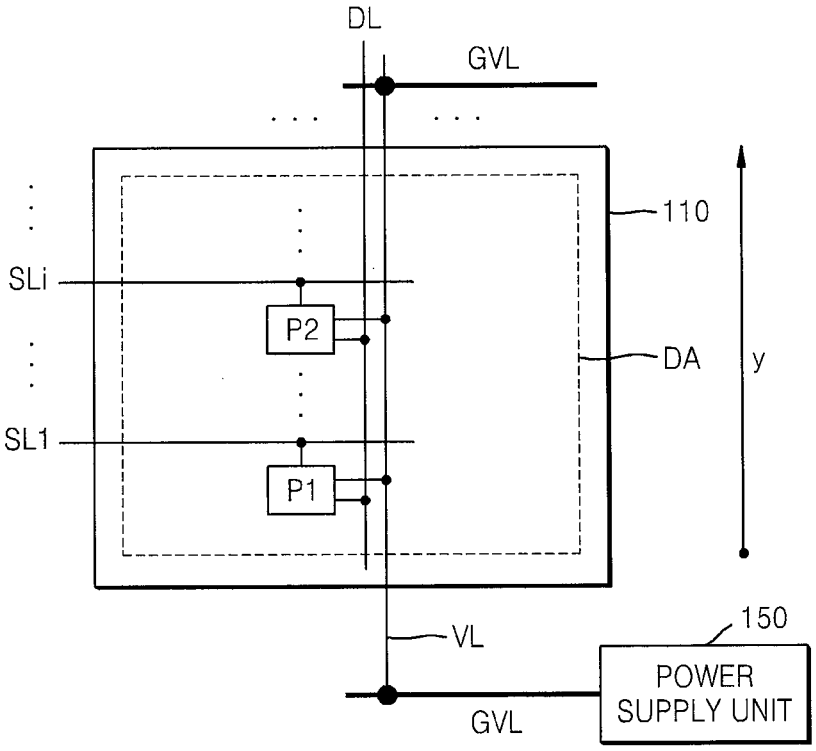
FIG. 3 is a diagram of a display panel according to an embodiment of the present invention.

FIG. 3 is a diagram showing the display panel 110 according to an embodiment of the present invention.

Referring to FIG. 3, the power lines VL are coupled to the pixel P to supply a power voltage to the pixel P. The power lines VL may receive the power voltage supplied from the power supply unit 150 via the global power line GVL. In the example shown in FIG. 3, the power lines VL may be arranged to correspond to the pixel columns, and supply the power voltages to the pixels P in the same column.

The global power lines GVL may be outside of the display area DA, and may be coupled to one end or opposite ends of the power lines VL. In the example shown in FIG. 3, the global power lines GVL are coupled to opposite ends of the power line VL.

Figure 4:
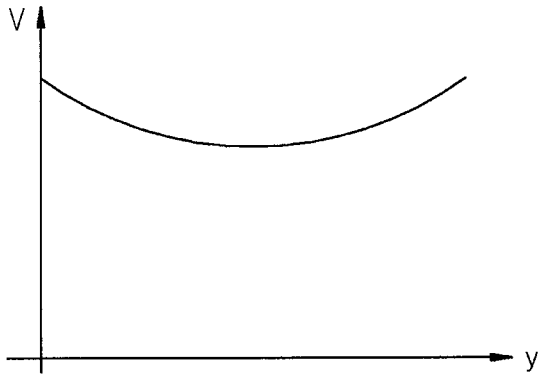
FIG. 4 is a graph showing voltage levels of power lines according to locations thereof at the display panel shown in FIG. 3.

FIG. 4 is a graph showing a voltage level of the power lines VL according to locations thereof on the display panel 110 shown in FIG. 3.

In the graph shown in FIG. 4, a transverse axis denotes locations of the pixels P receiving the power voltage from the same power line VL, that is, locations in a y-axis direction of the pixels P arranged in the same column in the example shown in FIG. 3, and a longitudinal axis denotes a level of the power voltages applied to the pixels P according to the locations of the pixels P. Referring to FIG. 4, the level of the power voltages applied to the pixels P may vary depending on the locations of the pixels P. For example, the level of the power voltage applied to each of the pixels P may vary depending on a distance (e.g., an electrical distance) between the location of the pixel P and the global power line GVL. Here, the electrical distance between two points may correspond to a resistance between the two points.

Referring to FIGS. 3 and 4, during transferring the power voltage from the global power line GVL to the pixel P along with the power line VL, a voltage dropping may occur due to the resistance of the power line VL, and the level of the power voltage may be reduced. Accordingly, the level of the power voltage applied to the pixels P that receive the power voltage supplied from the same power line VL may be reduced when the pixel P is far from the global power line GVL. In a case where the global power lines GVL are coupled to the opposite ends of the power line as shown in FIG. 3, the voltage level in the power line VL is reduced from edges to a center of the power line VL. As described above, even when the same data signal is applied to the plurality of pixels P, the power voltages applied to the plurality of pixels P are different from each other, and thus, the OLEDs in the plurality of pixels may emit light of different brightness from each other. For example, in FIG. 3, a first pixel P1 and a second pixel P2 receive the power voltage from the same power line VL; however, since the second pixel P2 is farther from the global power line GVL than the first pixel P1 is, the power voltage applied to the second pixel P2 has a lower level than that of the power voltage applied to the first pixel P1. Moreover, even when the first pixel P1 and the second pixel P2 emit light according to the same logic level, the light emitted from the first pixel P1 and the second pixel P2 have different brightness.

In order to address the above problem, the driving transistors T2 may have different gate voltages according to the locations of the pixels P in the display area DA when the OLEDs emit light. When the OLEDs emit light, gate-source voltages of the driving transistors T2 may be determined according to electrical distances between the pixels P and the global power line GVL. For example, the gate-source voltage of the driving transistor T2 when the OLED emits light may be determined to be greater as the distance (e.g., an electrical distance) between the pixel P and the global power line GVL increases. According to the example shown in FIG. 3, the gate-source voltage of the driving transistor T2 in the second pixel P2 may be greater than the gate-source voltage of the driving transistor T2 in the first pixel P1.

Accordingly, by differentiating the gate-source voltages of the driving transistors T2, the brightness differences among the OLEDs caused by the non-uniformity in the power voltages may be compensated for. The gate voltage of the driving transistor T2 may be determined by the data signal applied to the pixel P.

In the pixel P configuration shown in FIG. 2, the gate voltage of the driving transistor T2 may be expressed by equation 2. In equation 2, time t is based on a point where the data signal is changed from turn-on status to turn-off status.

$$Vg(t) = V_{off} + (V_{on} - V_{off})\left(1 - e^{-\frac{t}{\tau}}\right) \quad (2)$$

Here, Vg denotes the gate voltage of the driving transistor T2, $V_{off}$ denotes a voltage of the off-level of the data signal, $V_{on}$ denotes a voltage at the on-level of the data signal, and $\tau$ denotes a time constant.

Referring to above equations 1 and 2, the electric current flowing in the driving transistor T2 is dependent upon the gate-source voltage of the driving transistor T2, and the gate voltage of the driving transistor T2 is dependent upon the data signal. Thus, the electric current flowing in the driving transistor T2, that is, the electric current flowing in the OLED, may be controlled by controlling the data signal.

Therefore, according to the embodiments of the present invention, a level of the power voltage applied to each of the pixels is predicted, and then, a data signal corresponding to the level is provided to the pixel so that the same driving currents may be provided to the pixels even when the levels of the power voltages applied to the plurality of pixels when the OLEDs in the pixels emit light, and thus, the OLEDs of the pixels may emit light of the same brightness.

Referring to equation 1, Vst may increase in order not to change the current $I_{T2}$ even when the power voltage ELVDD is reduced. Accordingly, an absolute value of the gate-source voltage level of the driving transistor T2 may be determined to be greater when a distance between the pixel P and the global power line GVL increases. For example, when the global power line GVL is located at the outside of the display area DA, the absolute value of the gate-source voltage level of the driving transistor T2 may be greater as the distance (e.g., the electrical distance) between the pixel P and the outside of the display area DA increases.

Figure 5:
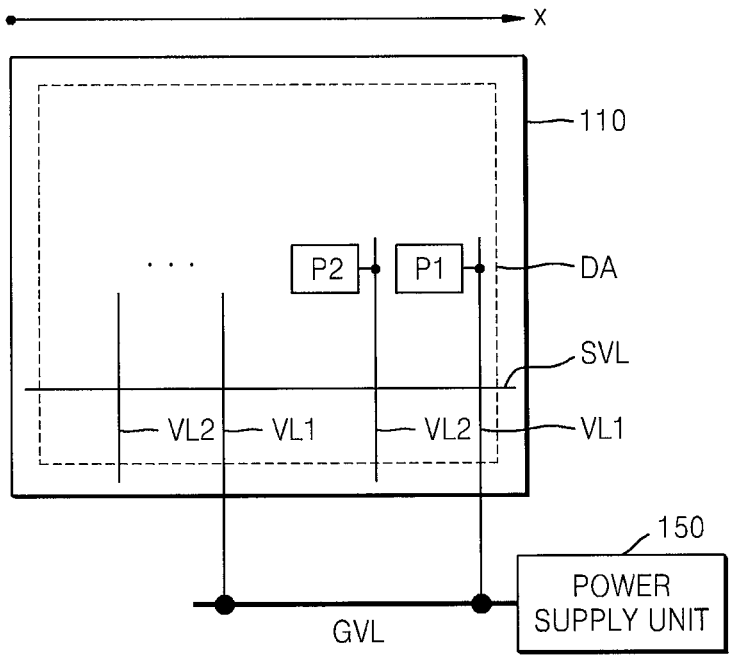
FIG. 5 is a diagram of a display panel according to an embodiment of the present invention.

FIG. 5 is a diagram showing the display panel 110 according to an embodiment of the present invention.

Referring to FIG. 5, the power lines VL receive the power voltage supplied from the power supply unit 150 via the global power lines GVL at the outside of the display area DA, and transmit the power voltages to the pixels P. Referring to FIG. 5, the power lines VL according to the present embodiment of the present invention may include a directly coupled power line VL1 that is directly coupled to the global power line GVL to receive the power voltage from the global power line GVL, and an indirectly coupled power line VL2 coupled to the directly coupled power line VL1 to receive the power voltage from the directly coupled power line VL1. Here, an additional auxiliary line SVL may be formed, and the auxiliary line SVL electrically couples the directly coupled power line VL1 and the indirectly coupled power line VL2 to each other. The power lines VL and the auxiliary line SVL may form a mesh structure. In the example shown in FIG. 3, the directly coupled power line VL1 or the indirectly coupled power line VL2 is formed to correspond to the pixel column, and supplies the power voltages to the pixels P in the same column.

In FIG. 5, the global power line GVL is located at a lower end of the display panel 110; however, the global power line GVL may be at an upper end of the display panel to be coupled to opposite ends of the directly coupled power line VL1 like the example shown in FIG. 3.

Figure 6:
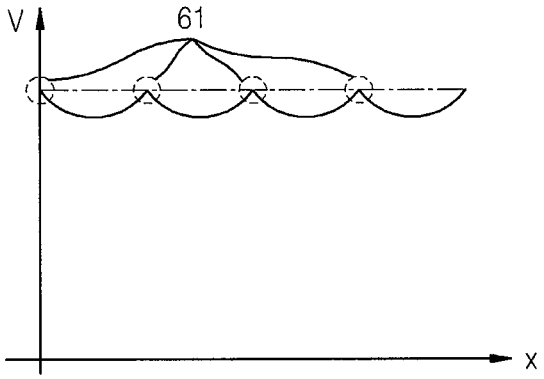
FIG. 6 is a graph showing voltage levels of power lines according to locations thereof at the display panel shown in FIG. 5.

FIG. 6 is a graph showing voltage levels of the power lines VL according to locations thereof on the display panel 110 of FIG. 5.

In the graph of FIG. 6, a transverse axis denotes locations of the pixels P in the same row on the display area DA, and the longitudinal axis denotes levels of the power voltages applied to the pixels P according to the locations of the pixels P. The pixels P in the same row may receive the power voltages from different power lines VL from each other. Referring to FIG. 6, the levels of the power voltages applied to the pixels P may vary depending on locations of the pixels P in the same row. For example, the level of the power voltage applied to each of the pixels P may vary depending on the electrical distance between the pixel P and the global power line GVL. The electrical distance between the pixel P and the global power line GVL may vary depending on the kind of power line VL coupled to the pixel P. Here, the electrical distance between two points corresponds to the resistance between the two points.

Referring to FIGS. 5 and 6, the power voltages applied to the pixels P may be different from each other due to the voltage dropping generated during transferring the power voltages from the global power line GVL to the pixels P.

As shown in FIG. 5, when the global power line GVL is directly coupled to the directly coupled power line VL1 and indirectly coupled to the indirectly coupled power line VL2 via the auxiliary line SVL, the electrical distance between the first pixel P1 coupled to the directly coupled power line VL1 and the global power line GVL is less than that between the second pixel P2 coupled to the indirectly coupled power line VL2 and the global power line GVL. Therefore, the power voltage applied to the second pixel P2 may be dropped more than that applied to the first pixel P1. That is, an absolute value of the power voltage applied to the second pixel P2 may be less than that of the power voltage applied to the first pixel P1.

The power voltage level may be shown in the graph of FIG. 6. Referring to FIG. 6, the power voltage 61 supplied from the directly coupled power line VL1 is less than the power voltage applied from the indirectly coupled power line VL2 to the pixels in the same row.

The above problem is described above with reference to FIGS. 3 and 4, and to address the above problem, the driving transistors T2 in the pixels P may have different gate voltages according to the locations of the pixels P in the display area DA, when the OLEDs emit light. According to the example shown in FIG. 5, the gate-source voltage of the driving transistor T2 in the second pixel P2 may be greater than the gate-source voltage of the driving transistor T2 in the first pixel P1.

Accordingly, by differentiating the gate-source voltage of the driving transistor T2, the brightness difference of the OLED caused by the non-uniformity of the power voltage may be compensated for. The gate voltage of the driving transistor T2 may be determined by the data signal applied to the pixel P.

Referring to equation 1, Vsg may increase in order not to change the current $I_{T2}$ even when the power voltage ELVDD is reduced. Accordingly, an absolute value of the gate-source voltage level of the driving transistor T2 may be determined to be greater when a distance between the pixel P and the global power line GVL increases. For example, when the global power line GVL is located at the outside of the display area DA and is only coupled to the directly coupled power line VL1 that is a part of the power lines VL, the absolute value of the gate-source voltage level of the driving transistor T2 may be greater as the distance between the pixel P and the outside of the display area DA increases.

According to the present embodiment of the present invention, a data signal further including an emphasis signal for controlling the gate voltage of the driving transistor T2, in addition to the image signal of the high or low logic level, is provided. To do this, the data control signal DCS may include information about the image signal and information about the emphasis signal. The information about the emphasis signal may be determined based on a location of the pixel P on the display area DA. Examples of the data signal according to the embodiments of the present invention will be described with reference to FIGS. 7A and 7B.

Figure 7A:
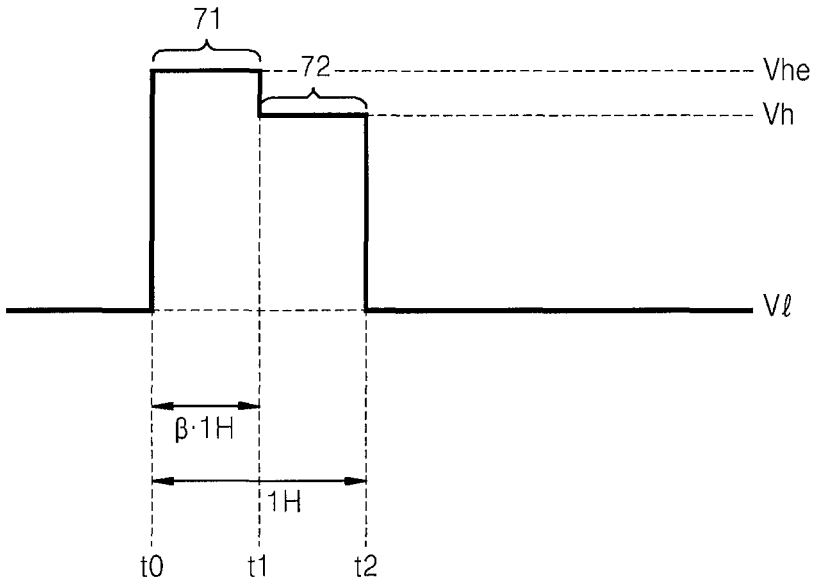
FIGS. 7A and 7B are diagrams showing examples of a data signal including an image signal and an emphasis signal.
Figure 7B:
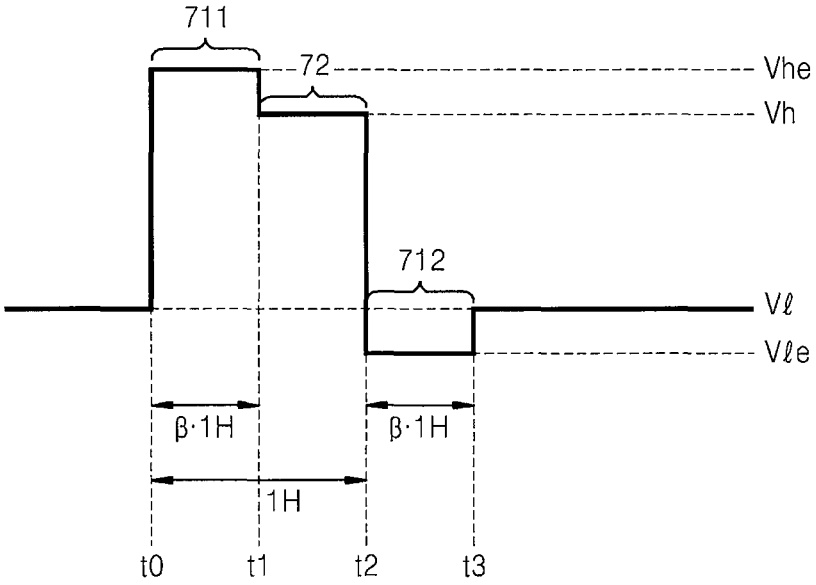

FIGS. 7A and 7B are diagrams showing examples of the data signal including the image signal and the emphasis signal.

Referring to FIG. 7A, the data signal may include an emphasis signal 71 and an image signal 72. The data signal has a unit section of 1H, and the unit section includes an emphasis section or portion in which the emphasis signal 71 is input and an image section or portion in which the image signal 72 is input. The information about the emphasis signal included in the data control signal DCS may include a voltage level Vhe and an application time $\beta \cdot 1H$. $\beta$ may be greater than 0 and less than 1. Since the gate voltage of the driving transistor T2 may be controlled by the voltage level Vhe and the application time $\beta \cdot 1H$ of the emphasis signal, at least one of the voltage level Vhe and the application time $\beta \cdot 1H$ of the emphasis signal may be determined according to the electrical distance between the pixel P and the global power line GVL (or according to a location of the pixel P on the display area DA). For example, as the pixel P becomes far from the outside of the display area DA or as the electrical distance between the pixel P and the directly coupled power line VL1, that is, between the pixel P and the global power line GVL, is increased, the controller 140 may increase the voltage level Vhe and the application time β·1H of the emphasis signal.

Referring to FIG. 7A, during the unit section 1H in which the data signal of the on-level is input, the emphasis signal 71 and the image signal 72 may be input to the pixel P via the data line. For example, the emphasis signal 71 may be input during a time of β·1H from t0 to t1, the image signal 72 of the on-level is input during a time of (1−β)·1H from t1 to t2, and when the input during the unit section 1H is finished, the data signal enters the off-level.

The image signal 72 may have a logic level of on-level or off-level, and the on-level may be a high level or a low level according to the embodiments of the present invention. In the present embodiment, it is assumed that the on-level is the high level.

The voltage level Vhe of the emphasis signal 71 may be greater than the high level Vh of the image signal 72. When the on-level is the low level, the voltage level Vhe of the emphasis signal 71 may be less than the low level of the image signal 72.

Referring to FIG. 7B, the emphasis signal may include a first emphasis signal 711 and a second emphasis signal 712. The first emphasis signal 711 may be input before inputting the image signal 72, and the second emphasis signal 712 may be input after finishing the input of the unit section 1H. The first emphasis signal 711 and the second emphasis signal 712 may be input for the same time period β·1H. The unit section 1H may include the first emphasis signal 711 and the image signal 72.

Referring to FIG. 7B, a voltage level Vhe of the first emphasis signal 711 may be greater than a high level Vh of the image signal 72, and a voltage level Vle of the second emphasis signal 712 may be less than the low level Vl of the image signal.

When the data signal shown in FIG. 7A or FIG. 7B is provided to the pixel P shown in FIG. 2, the gate voltage of the driving transistor T2 may be expressed by equation 3. In addition, since the gate voltage of the driving transistor T2 is maintained at the gate voltage level when the unit section 1H is finished (t2), the gate voltages of the driving transistors T2 in cases where the pixels P to which the data signals in FIGS. 7A and 7B are respectively provided may be expressed by equation 3.

$$Vg(t) = Vhe\left(1 - e^{-\frac{t}{\tau}}\right)\cdot u(t) - (Vhe - Vh)\left(1 - e^{-\frac{t-\beta\cdot 1H}{\tau}}\right)\cdot u(t - \beta\cdot 1H) \quad (3)$$

The gate voltage at the time point t2 where the input of the unit section 1H is finished is maintained as the gate voltage of the driving transistor T2 while the pixel P emits light, and the gate voltage of the driving transistor T2 may be expressed by equation 4 while the pixel P emits light.

$$Vg(1H) = Vhe\left(1 - e^{-\frac{1H}{\tau}}\right)\cdot u(1H) - (Vhe - Vh)\left(1 - e^{-\frac{(1-\beta)\cdot 1H}{\tau}}\right)\cdot u((1-\beta)\cdot 1H) \quad (4)$$

Referring to equation 4, the gate voltage of the driving transistor T2 may be adjusted by adjusting β during the light emission. That is, the gate voltage of the driving transistor T2 may be adjusted by adjusting the application time of the emphasis signal.

In addition, referring back to equation 1, when the first power voltages ELVDD applied to two pixels P are different from each other, the gate voltages of the driving transistors T2 in the pixels P for allowing the same currents to flow in the OLEDs in the two pixels P may be calculated. Calculated gate voltages, that is, values of the desired gate voltages, are substituted in equation 4, and then, the application time β·1H of the emphasis signal may be calculated.

That is, by using the power voltage value that is actually applied to the pixel P according to the location of the pixel P, the gate voltage level of the driving transistor T2 may be calculated. In addition, the application time of the emphasis signal for maintaining the desired gate voltage at the gate node of the driving transistor T2 may be calculated.

In addition, referring to equation 4, the gate voltage of the driving transistor T2 during the light emission may be adjusted by adjusting the voltage Vhe in a case where β is constant. That is, when at least one of the voltage level and the voltage application time of the emphasis signal is controlled, the gate voltage of the driving transistor T2 may be adjusted and the uneven brightness of the OLEDs may be compensated for.

Figure 8:
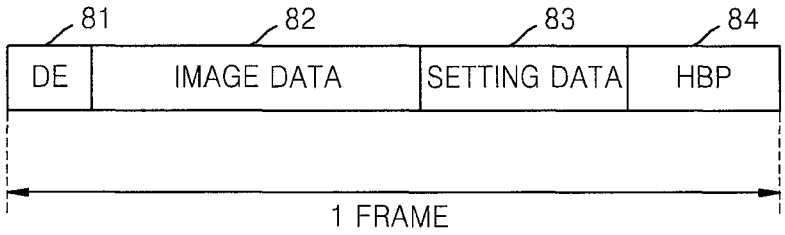
FIG. 8 is a diagram showing an example of a data control signal transmitted from a controller to a data signal.

FIG. 8 is a diagram showing an example of the data control signal DCS transmitted from the controller 140 to the data driving unit 130.

Referring to FIG. 8, the data control signal DCS may include information about generation of the data signal corresponding to one line. In a case of digital driving, one piece of line data may include data of a plurality of sub-frames. Referring to FIG. 8, the data control signal DCS corresponding to one piece of line data may include a data enable data 81, image data 82, setting data 83, and horizontal blank period data 84. The image data 82 may include image signal information that will be applied to each of the data lines DL, and the setting data 83 may include information of the emphasis signal and information about other functions. The information of the functional data may include the voltage level and the application time of the emphasis signal.

Figure 9:
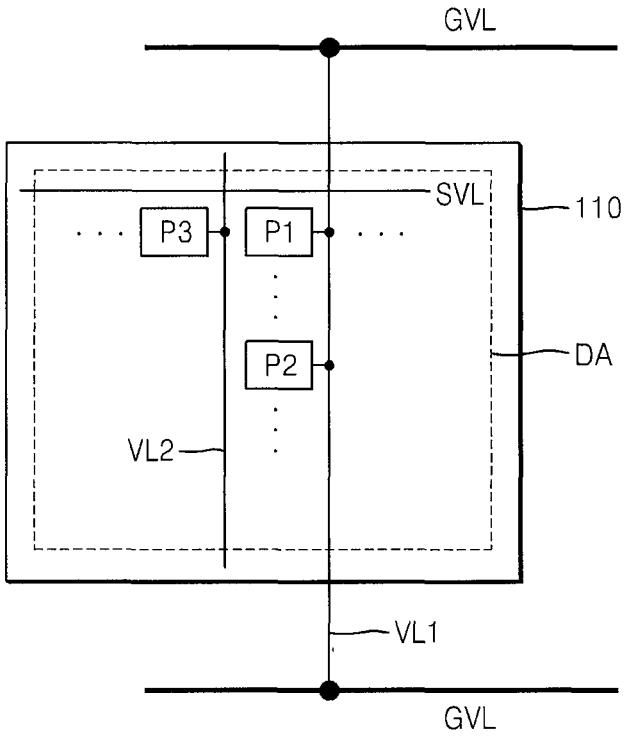
FIG. 9 is a diagram showing a display panel according to an embodiment of the present invention.

FIG. 9 is a diagram showing an example of the display panel 110 according to an embodiment of the present invention.

Referring to FIG. 9, the power voltage supplied to the first pixel P1 is greater than the power voltage applied to the second pixel P2, and may be greater than the power voltage applied to a third pixel P3. Due to the difference between the power voltages, the brightness of the light emission may be different even if the pixels P emit light by receiving the same image signal. According to the present embodiment of the present invention, the emphasis signal may be applied to each of the pixels P in order to compensate for the unevenness of the emitting brightness, and at least one of the voltage level and/or the application time of the emphasis signal may be controlled.

In addition, according to another embodiment of the present invention, the driving transistors P of the pixels P may have different sizes according to the locations of the pixels P. For example, in order to compensate for the brightness difference caused by the different power voltages applied to the pixels P, the driving transistor T2 may have different sizes. The size of the driving transistor may be represented by a channel length and/or a channel width of the transistor.

By adjusting the sizes of the transistors, the same voltage Voled may be applied to opposite terminals of the OLED in each of the pixels even when the power voltages applied to two pixels are different from each other, and the same currents Ioled may flow in the OLEDs.

The size of the driving transistor T2 may be increased as the electrical distance between the pixel P and the global power line GVL is increased. The sizes of the pixels P coupled to the same power line VL may be increased as the distance (e.g., the electrical distance) between the pixels and the outside of the display area DA increases. The size of the pixel P coupled to the indirectly coupled power line VL2 may be greater than the size of the pixel P coupled to the directly coupled power line VL1. In a case where the power line VL is located at each of the pixel rows, the size of the pixel P coupled to the indirectly coupled power line VL2 may be greater than that of the pixel P coupled to the directly coupled power line VL1 in the pixels P of the same column. When the power line VL is located at each of the pixel columns, the size of the pixel P coupled to the indirectly coupled power line VL2 may be greater than that of the pixel P coupled to the directly coupled power line VL1 in the pixels P of the same row. In a case of two pixels P coupled to different indirectly coupled power lines VL2, the size of the pixel P may be greater when the electrical distance between the indirectly coupled power line VL2 and the directly coupled power line VL1 coupled to each other via the auxiliary line SVL increases.

In the example of FIG. 9, the second pixel P2 has a size greater than that of the first pixel P1, and the third pixel P3 has a size greater than that of the first pixel P1.

The difference between the sizes of the pixels in the same column coupled to the same power line VL may be greater than the difference between the sizes of the pixels in the same row coupled to the different power lines VL; however, one or more embodiments are not limited thereto. That is, the differential degree between the pixel sizes may be determined by an actual dropping amount of the power voltage.

A method of driving the display apparatus according to the present embodiment of the present invention includes outputting the data control signal DCS that includes information about the image signal and information about the emphasis signal and will be input to each of the pixels P from the controller 140 according to the location of the pixel P, receiving the data signal DCS by the data driving unit 130 from the controller 140, and outputting the data signal including the image signal and the emphasis signal based on the data control signal DCS from the data driving unit 130. The data signal includes a unit section corresponding to the sub-frame in the digital driving type, and the unit section includes an emphasis section in which the emphasis signal is input and an image section in which the image signal is input. The outputting of the data control signal DCS includes outputting the information about the emphasis signal according to the length of the emphasis section, which is determined according to the electrical distance between the pixel and the global power line.

As described above, according to the one or more of the above embodiments of the present invention, uniformity in displaying brightness may be increased (e.g., improved).

It should be understood that the example embodiments described herein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made herein without departing from the spirit and scope of the present invention as defined by the following claims, and equivalents thereof.

What is claimed is:

1. An organic light emitting display apparatus comprising:

a plurality of pixels, each of the pixels comprising a light emitting device and a driving transistor configured to supply a driving current to the light emitting device based on a scan signal and a data signal; and a plurality of power lines configured to transfer a power voltage supplied from a global power line to the driving transistor of each of the pixels, wherein a level of a gate voltage of the driving transistor when the light emitting device emits light is determined by a distance between a corresponding one of the pixels and the global power line, and wherein an absolute value of a gate-source voltage level at the driving transistor when the light emitting device emits light increases as the distance between the corresponding one of the pixels and the global power line increases.

2. The organic light emitting display apparatus of claim 1, wherein the plurality of pixels are at a display area, the global power line is at an outside of the display area, and an absolute value of a gate-source voltage level at the driving transistor increases as a distance between the corresponding one of the pixels and the outside of the display area increases.

3. The organic light emitting display apparatus of claim 1, further comprising a data driver configured to acquire a data control signal from a controller and to generate the data signal based on the data control signal, wherein the data signal comprises an image signal and an emphasis signal, the plurality of pixels are at a display area, and the data control signal comprises information of the emphasis signal determined according to a location of the corresponding one of the pixels at the display area.

4. The organic light emitting display apparatus of claim 3, wherein the information of the emphasis signal comprises a voltage level and an application time of the emphasis signal, and at least one of the voltage level and the application time is determined based on a distance between a power supplier and the pixel.

5. The organic light emitting display apparatus of claim 3, wherein the global power line is at the outside of the display area to be coupled to an end or opposite ends of each of the power lines, and at least one of the voltage level and an application time of the emphasis signal is increased as a distance between the corresponding one of the pixels and the outside of the display area increases.

6. The organic light emitting display apparatus of claim 3, wherein the emphasis signal is determined by following equation, $$Vg(1H) = Vhe\left(1 - e^{-\frac{1H}{\tau}}\right) \cdot u(1H) - (Vhe - Vh)\left(1 - e^{-\frac{(1-\beta)\cdot 1H}{\tau}}\right) \cdot u((1-\beta)\cdot 1H) \text{ where } 0 \le \beta < 1$$

wherein Vg denotes a gate voltage of the driving transistor, Vhe denotes a voltage level of the emphasis signal, 1H denotes a unit period of the data signal, τ denotes a time constant, Vh is an on-level of the image signal, and β·1H is an application time of the emphasis signal.

7. The organic light emitting display apparatus of claim 3, wherein an on-level of the image signal is a logic high level or a logic low level, and the voltage of the emphasis signal is greater than the logic high level of the image signal or less than the logic low level of the image signal.

8. The organic light emitting display apparatus of claim 7, wherein the emphasis signal comprises a first emphasis signal and a second emphasis signal, and a voltage of the first emphasis signal is greater than the logic high level of the image signal and a voltage of the second emphasis signal is less than the logic low level of the image signal.

9. The organic light emitting display apparatus of claim 8, wherein the first emphasis signal is supplied before supplying the logic high level and the second emphasis signal is supplied before supplying the logic low level.

10. The organic light emitting display apparatus of claim 1, wherein the plurality of pixels are arranged in columns and rows at a display area, the plurality of power lines are at each of the columns or at each of the rows of the pixels, the global power line is at an outside of a display panel, the plurality of power lines comprise a directly coupled power line and an indirectly coupled power line, an end or opposite ends of the directly coupled power line are coupled to the global power line to receive the power voltage, and the indirectly coupled power line is electrically coupled to the directly coupled power line via an auxiliary line to receive the power voltage via the directly coupled power line.

11. The organic light emitting display apparatus of claim 10, wherein a size of the driving transistor increases as a distance between the corresponding one of the pixels and the global power line increases.

12. The organic light emitting display apparatus of claim 11, wherein the size of the driving transistor is expressed by at least one of a channel width and a channel length of the driving transistor.

13. The organic light emitting display apparatus of claim 10, wherein sizes of pixels from among the plurality of pixels coupled to a same power line increase as a distance between the pixels coupled to the same power line and the outside of the display area increases.

14. The organic light emitting display apparatus of claim 10, wherein a size of a pixel from among the plurality of pixels coupled to the indirectly coupled power line is greater than a size of a pixel from among the plurality of pixels coupled to the directly coupled power line.

15. The organic light emitting display apparatus of claim 14, wherein the power line is at each of the columns of pixels, and a size of a pixel from among the pixels included in a same row coupled to the indirectly coupled power line is greater than a size of a pixel from among the pixels included in the same row coupled to the directly coupled power line.

16. The organic light emitting display apparatus of claim 14, wherein the power line is at each of the rows of pixels, and a size of a pixel from among the pixels included in a same column coupled to the indirectly coupled power line is greater than a size of a pixel from among the pixels included in the same column coupled to the directly coupled power line.

17. The organic light emitting display apparatus of claim 10, wherein a size of the corresponding one of the pixels coupled to the indirectly coupled power line increases when a distance between the indirectly coupled power line and the directly coupled power line that are coupled to each other via the auxiliary line increases.

18. An organic light emitting display apparatus comprising:

a plurality of pixels, each of the pixels comprising a light emitting device and a driving transistor configured to supply a driving current to the light emitting device based on a scan signal and a data signal; and a plurality of power lines configured to transfer a power voltage supplied from a global power line to the driving transistor of each of the pixels, wherein a unit period 1h of the data signal comprises an emphasis period during which an emphasis signal is input and an image period during which an image signal is input, and a magnitude of the emphasis signal or a length of the emphasis period is determined according to a distance between each of the pixels and the global power line.

19. A method of driving a display apparatus comprising:

a plurality of pixels;

a plurality of data lines coupled to the plurality of pixels, and power lines configured to apply power voltages supplied from a global power line to the plurality of pixels, the method comprising:

outputting a data control signal including information about an image signal and information about an emphasis signal by a controller according to locations of each of the plurality of pixels, wherein the data control signal is input to each of the plurality of pixels;

receiving the data control signal by a data driver from the controller; and outputting a data signal including the image signal and the emphasis signal by the data driver based on the data control signal, wherein the data signal comprises a unit period that corresponds to a sub-frame of a digital driving method, and the unit period comprises an emphasis period during which the emphasis signal is input and an image period during which the image signal is input, and the outputting of the data control signal comprises outputting information of the emphasis signal according to a length of the emphasis signal, which is determined according to a distance between each of the pixels and the global power line.

* * * * *